US009118995B1

(12) United States Patent
Feeley et al.

(10) Patent No.: US 9,118,995 B1
(45) Date of Patent: Aug. 25, 2015

(54) EARPIECE AUDITORY DEVICES HAVING IMPROVED EAR TIPS

(75) Inventors: James Feeley, Tulsa, OK (US); Mike Feeley, Tulsa, OK (US)

(73) Assignee: Hear-Wear Technologies LLC, Tulsa, OK (US)

( * ) Notice: Subject to any disclaimer, the term of this patent is extended or adjusted under 35 U.S.C. 154(b) by 41 days.

(21) Appl. No.: 13/430,493

(22) Filed: Mar. 26, 2012

(51) Int. Cl.
*H04R 1/10* (2006.01)

(52) U.S. Cl.
CPC ..... *H04R 1/1016* (2013.01); *H04R 1/1058* (2013.01); *H04R 1/1066* (2013.01)

(58) Field of Classification Search
CPC .... H04R 1/1016; H04R 25/00; H04R 25/652; H04R 2225/023; H04R 2460/09; H04R 25/65; H04R 1/1058; H04R 1/1066; H04R 1/10; A06F 11/08
USPC ..... 381/380, 328, 322, 330, 381; 181/130, 181/135
See application file for complete search history.

(56) References Cited

U.S. PATENT DOCUMENTS

| | | | | |
|---|---|---|---|---|
| 2,430,229 | A | 11/1947 | Kelsey | |
| 2,487,038 | A | 11/1949 | Baum | |
| 3,123,678 | A | 3/1964 | Prentiss et al. | |
| 3,457,375 | A | 7/1969 | Haggerty | |
| 3,783,201 | A | 1/1974 | Weiss | |
| 4,870,688 | A * | 9/1989 | Voroba et al. | 381/60 |
| 5,606,621 | A | 2/1997 | Reiter et al. | |
| 5,701,348 | A * | 12/1997 | Shennib et al. | 381/328 |
| 5,761,298 | A * | 6/1998 | Davis et al. | 379/430 |
| 5,887,070 | A | 3/1999 | Iseberg | |
| 7,016,512 | B1 * | 3/2006 | Feeley et al. | 381/324 |
| 7,113,611 | B2 | 9/2006 | Leedom et al. | |
| 8,462,971 | B2 * | 6/2013 | Gommel et al. | 381/322 |
| 2002/0027996 | A1 | 3/2002 | Leedom | |
| 2008/0118095 | A1 * | 5/2008 | Fletcher | 381/328 |

FOREIGN PATENT DOCUMENTS

| | | |
|---|---|---|
| EP | 0494991 | 7/1992 |
| WO | WO 99/07182 | 2/1999 |
| WO | WO 2011088600 A1 * | 7/2011 |

OTHER PUBLICATIONS

Sonotone Model 300X Hearing Aid, The Hearing Aid Museum, 1965.
Zenith Diplomat Hearing Aid, The Radio Museum, Jun. 1957.

* cited by examiner

*Primary Examiner* — Davetta W Goins
*Assistant Examiner* — Oyesola C Ojo
(74) *Attorney, Agent, or Firm* — Norton Rose Fulbright US LLP

(57) ABSTRACT

Systems, devices and methods relating to auditory devices having an ear tip with a neck portion configured to extend beyond the end of a speaker assembly when assembled are provided. Embodiments provide for an ear tip with enhanced flexibility for insertion and removal and while the ear tip is in use. Additionally, embodiments may provide for a fastening means that allows the ear tip to be easily detachable from a speaker assembly, while also providing sufficient securing force for the ear tip to secure the tip to the speaker assembly while the tip is subjected to forces resulting from insertion, removal or otherwise normal use of the auditory device.

26 Claims, 5 Drawing Sheets

EARPIECE AUDITORY DEVICES HAVING IMPROVED EAR TIPS

TECHNICAL FIELD

The present application relates to earpiece auditory devices, and more specifically earpiece auditory devices having improved ear tips.

BACKGROUND

Conventional earpiece auditory devices (e.g., earphones, headphones, headsets, monitors, IFB devices, hearing aids, earplugs, etc.) generally include some form of an ear tip or ear mold (used interchangeably herein) to provide for stability and user comfort of a device which is placed in the ear. However, coupling sound from a receiver or speaker into an individual's ear canal presents many design challenges including achieving high fidelity sounds, comfortable fit, acoustic sealing, safety and ease of insertion and removal.

Part of these challenges arise due to the anatomy of the ear canal, which may vary considerably among different users. Typically the ear canal comprises a concha portion which can be thought of as the outer bowl of the ear located behind the tragus. Moving inward, an ear has a transition zone, and an aperture which typically marks the beginning of the ear canal. An ear canal is generally "S" shaped with a first bend starting near the aperture, and a second bend starting near the cartilaginous-bony portion transition. These locations of these bends may vary among different people as well as the diameter and depth of the ear canal. Additionally, the deformations that occur in an ear canal due to jaw movements and other normal motion vary greatly among different people.

Each of these anatomical aspects are generally considered when designing any component which resides in the ear canal. Because of the vast variance between users, some auditory devices, typically hearing aids, utilize custom fit molds to secure a speaker in the ear canal. Such custom fit molds are typically expensive and require complicated fitting and manufacturing processes.

Other solutions include placing generically shaped ear tips over the speaker. Some embodiments of such ear tips are designed to be placed in an ear canal of a user include a soft material which is shaped in a umbrella or mushroom-style fashion, and are designed to circumscribe a speaker assembly. This layout, however, can be less than ideal. For example, because the mushroom portion of the ear tip and speaker assembly are substantially located within the same axial plane, the ability of the ear tip to bend and flex while being inserted is significantly limited by the structure of the speaker assembly. This problem is exacerbated when the speaker assembly is inserted past one or more bends in the ear canal.

Another difficult issue prevalent in the design of ear tips corresponds to methods of securing the ear tip on the speaker assembly itself. For example, it would be unacceptable to have an auditory device configured to be inserted into the ear canal that includes an ear tip which is prone to disconnecting from the speaker assembly within the ear canal. Accordingly, an ear tip cannot sit too loosely on the speaker assembly. Moreover, an ear tip must be generally designed and connected in a manner which prevents forces due to insertion and removal of the speaker assembly itself to allow the ear tip to be separated from the speaker assembly. Because of this, ear tip designers generally may require a portion of the ear tip to have an elastic fit that forms snugly over the speaker assembly. In this manner, the ear tip is not exposed to the normal friction and bending stemming from daily use without the speaker assembly structure acting as a limit on such forces to prevent disconnection of the ear tip from the speaker assembly.

Conversely, an ear tip with such a snug elastic fit maintains an exceedingly tight fit on the speaker assembly and may be difficult for a user to exchange in the event that the ear tip becomes clogged with debris or worn out. This is particularly true in the hearing aid industry where primary users are often elderly patients. Currently, the hearing aid industry typically errs on the side of caution and utilizes ear tips which fit snugly and are exchanged by a specialist.

In non-hearing aid devices, such as audio headphones, typically ear tips do not extend into the ear canal much past the aperture, and certainly not deeply in the ear canal (e.g. near the second bend). In fact, such devices generally seat in the concha of the ear. More recent headphone models may include a tip that seats in the aperture of the ear, while the coupling of the speaker to the ear tip resides outside of the ear. However, for a high number of users, these devices are uncomfortable and cause soreness in the outer ear with prolonged use and are difficult to keep in position properly in the ear.

BRIEF SUMMARY

The present application provides for systems, devices and methods relating to auditory devices having an ear tip with a neck portion configured to extend beyond the end of a speaker assembly when assembled. Embodiments provide for an ear tip with enhanced flexibility for insertion and removal and while the ear tip is in use. Additionally, embodiments may provide for a fastening means that allow the ear tip to be easily detachable from a speaker assembly, while also providing sufficient securing force for the ear tip to secure the tip to the speaker assembly while the tip is subjected to forces resulting from insertion, removal or otherwise normal use of the auditory device.

Embodiments may provide for an ear tip which is meant to be inserted into the ear canal, and in some instances embodiments may provide for deep insertion (e.g. near or past the second bend) of an ear tip into the ear canal. It is appreciated that the depth of insertion effects many properties of an auditory device. For example, deep insertion may assist in minimizing or preventing the occlusion effect. The depth of insertion may also assist in providing improved sound quality, in sealing the ear canal, etc.

In accordance to an example embodiment an auditory device is provided. The auditory device includes a behind-the-ear component having sound processing circuitry, a completely-in-canal (CIC) component which includes a speaker casing having a proximal end and a distal and an ear tip attachment means extending past the distal end. The auditory device further includes a connector configured to couple the behind-the-ear component to the completely-in-canal component. Additionally, the auditory device includes an ear tip having an extended neck portion and a user contact portion that is configured to couple to the attachment means of the CIC device and configured such that said extended neck portion extends substantially beyond the end of said attachment means.

Another embodiment may be described as an ear tip which includes a hollow elongated neck portion defining an axial length and has a first and second end. A tip portion is formed on the first end and is configured to be flexible in order to assist with the insertion of said tip within an ear canal. Additionally, the ear tip includes an attachment portion disposed within the inner surface of the hollow elongated neck portion where the attachment portion is disposed at a point along the axial length such that the axial length extends beyond said attachment portion toward said first end.

In yet another embodiment a method for creating an ear tip is provided. The method includes forming an elongated hollow tube portion having a first end and a second end. Additionally, the method includes disposing a speaker assembly attachment portion within the elongated hollow tube portion, where the speaker assembly attachment portion is placed proximate to the first end and allows for a portion of the elongated hollow tube portion to extend beyond the speaker assembly attachment portion. Further, the method includes forming, on the second end, a user contact portion configured to contact the surface of a user's ear canal.

The foregoing has outlined rather broadly the features and technical advantages of the present application in order that the detailed description that follows may be better understood. Additional features and advantages will be described hereinafter which form the subject of the claims of the present application. It should be appreciated by those skilled in the art that the conception and specific embodiments disclosed may be readily utilized as a basis for modifying or designing other structures for carrying out the same purposes of embodiments of the present invention. It should also be realized by those skilled in the art that such equivalent constructions do not depart from the spirit and scope of the invention as set forth in the appended claims. The novel features which are believed to be characteristic of embodiments of the present invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present application.

BRIEF DESCRIPTION OF THE DRAWINGS

For a more complete understanding of the present application, reference is now made to the following descriptions taken in conjunction with the accompanying drawings, in which.

DETAILED DESCRIPTION

Figure 1:
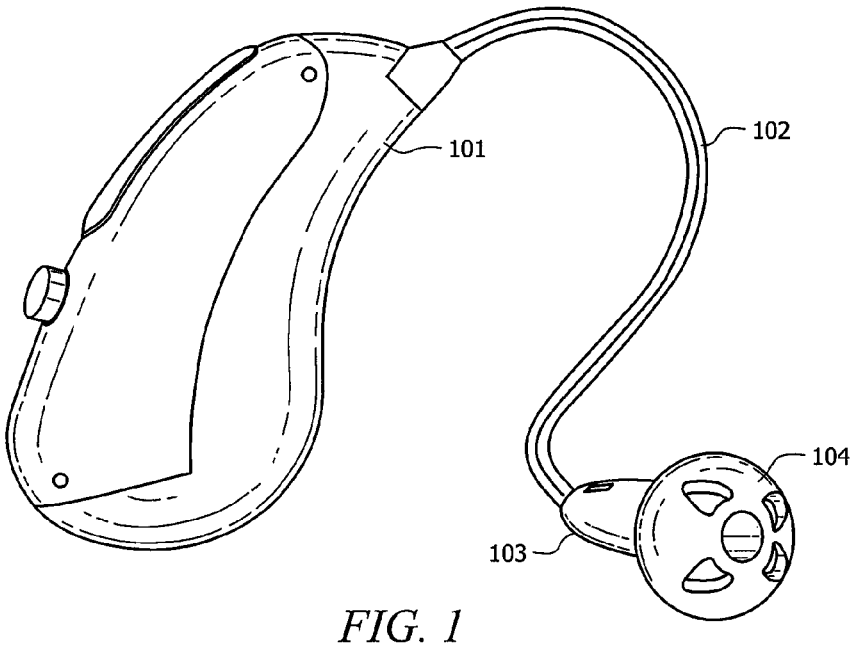
FIG. 1 illustrates a hearing aid device in accordance with an embodiment of the present application.

FIG. 1 illustrates a hearing aid device 100 in accordance with an embodiment of the present application. It is noted that hearing aid device 100 is illustrated as a hybrid behind-the-ear (BTE) and completely-in-canal (CIC) device. However, concepts of the present application may be utilized on other types of hearing aid devices such as acoustic tube devices, in-canal devices, in-the-ear devices, or any other device which fits within the ear canal or outside of the ear canal.

Device 100 includes a BTE component 101, connector cable 102, receiver assembly 103, and ear tip 104. In general, BTE component 101 of hearing aid device 100 may include a microphone, signal processing circuitry, a power supply (e.g. battery), and volume controls and/or a power switch. The processing circuitry is configured to receive sound signals from the microphone or another source and output amplified (or otherwise filtered/modified) signals to a speaker located in receiver assembly 103.

Connector cable 102 may be detachable from a BTE component 101 and may be pre-formed to be shaped such that connector cable 102 may run along the side of a user's head and ear so as to remain inconspicuous. Connector cable may also include wires which connect signal processing circuitry within BTE component 101 to a speaker within receiver assembly 103. Additionally, connector cable 103 may be constructed such that it may be used to insert and remove receiver assembly 103 and ear tip 104. In some embodiments, connector cable 102 may be formed in a manner such that the shape and/or length may prevent the receiver assembly 103 and/or ear tip 104 from being inserted too far within the canal.

Speaker assembly 103 may include a housing which encases and protects a speaker. Speaker assembly 103 may also include a connection means for connecting ear tip 104 (discussed in more detail below). In the illustrated embodiment, speaker assembly 103 is part of a CIC component which is configured to be inserted completely in a user's ear canal.

Ear tip 104 is configured to be connected to speaker assembly 103, and when in use, ear tip 104 is configured to maintain placement of speaker assembly 103 and to provide for a comfortable fit of an inserted CIC component. Ear tip 104 may be provided in a sealed, vented or an open mold configuration. Such aspects of ear tip 104 are discussed in more detail below.

Figure 2:
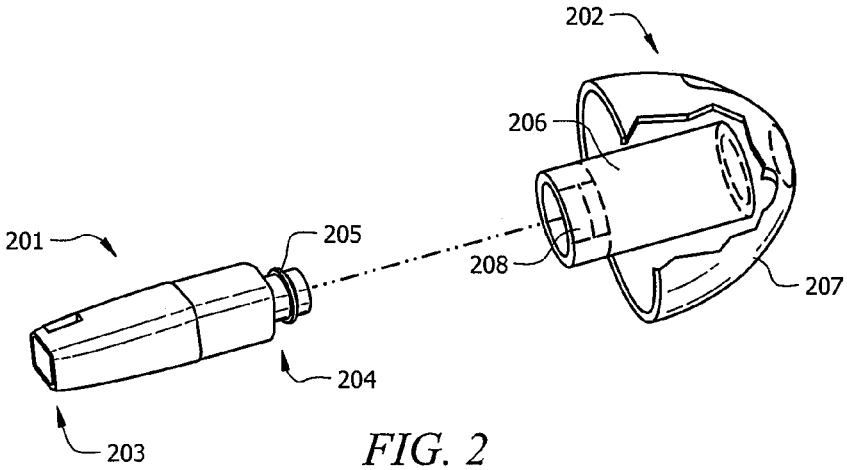
FIG. 2 illustrates a separated receiver assembly and ear tip in accordance with an embodiment of the present application.

FIG. 2 illustrates a separated receiver assembly 201 and ear tip 202 in accordance with an embodiment of the present application. Receiver assembly 201 may be part of hearing aid device 100 as discussed above, or may be part of any other type of auditory device such as audio headphones and the like. Receiver assembly 201 may include a casing having a proximal end 203 and a distal end 204. The casing may include an ear tip attachment means 205 extending past distal end 204. Alternatively, attachment means 205 may be included within distal end 204. In some embodiments, attachment means 205 is configured to attach to ear tip 202 such that the fit is sufficiently tight to form a seal which prevents sound leakage that can produce feedback within device 200. In the illustrated embodiment, attachment means 205 is illustrated as a snap fit ball configured to snap into a receiving portion 208 of ear tip 202 and maintain a friction fit. In other embodiments, attachment means 205 may comprise any other suitable form of attachment such as a screw/twist mechanism, latching mechanism, friction mechanism, and the like.

It is noted that in embodiments which include other types of hearing aid devices (such as an acoustic tube device), an attachment means such as attachment means 205 may be included on the end of an acoustic tube. Such an embodiment would not include a speaker casing as the speaker would be included outside of the ear canal. Additionally, in-the-ear, in-the-canal, or other designs that fit within the canal can be modified to include a connector means which attaches to the above-described tips. Further, hearing devices such as a monitor device, earphones or headsets may utilize multiple speakers, multiple acoustic tubes, or a combination of both. Ear phones or headsets that typically place the speaker outside of the ear canal may have an extender (e.g. an acoustic tube) to position the tip at various locations within the canal. It is contemplated that attachment means of tip 202 may be modified to accommodate such embodiments while still providing the advantages disclosed herein.

Ear tip 202 includes an extended neck portion 206 and a user contact portion 207. Ear tip 202 may be constructed of any suitable material which provides for durability and comfort while in use. For example some embodiments may utilize silicon, foam, elastomeric materials, and the like.

It is noted that dimensions of ear tip 202 may range in light of the type of device being implemented, the type of performance desired, and any other factor that may be impacted by differing dimensions. For example, the wall thickness of extended neck portion 206 may be configured to be as thin as possible to maximize the opening within extended neck portion 206 in order to facilitate sound propagation. Thin wall thickness may also assist in minimizing pressure onto the ear canal from ear tip 202, thereby maximizing user comfort. It is noted however, that the wall thickness of neck potion 206 should also be sufficient to allow requisite structural integrity of neck portion 206 to prevent collapsing of neck portion 206 when it is subjected to forces of insertion or other forces present during use of the auditory device. The wall thickness may also be altered in order to provide acoustic effects. For example, a thicker wall may be utilized to form an internal aperture which assists in the propagation or attenuates propagation of certain frequencies. Additionally, in some embodiments the wall thickness of neck portion 206 may vary from one end of tip 202 to the other. Such embodiments may do so in order to provide differing fit with no change to the internal opening, or may be utilized to accomplish acoustic goals (e.g. provide a horn-like internal opening for sound propagation).

Dimension of the length of components of ear tip 202 may also be altered in differing applications and embodiments. A current example embodiment includes a securing device (discussed with FIG. 4 below) that is 0.326 inches in length with a neck portion extending beyond the securing device another 0.228 inches. However it is contemplated that lengths could be a quarter of the length of this example and more than double these lengths. Current wall thicknesses are configured such that the elongated neck may deflect 10 degrees with 14 grams of lateral force, 25 degrees with 24 grams, and 45 degrees with 30 grams of force. Such forces and deflections are significantly configurable in light of the considerations discussed herein. Additionally, one current embodiment allows for an inserted ear tip device to place as little 0.5 grams of pressure on the ear canal, and in some instances even less. Such pressure measurements are accomplished with the increased flexibility while having still needed rigidity to prevent the ear tip from collapsing.

Ear tip 202 is configured to couple to attachment means 205 by receiving attachment means 205 within receiving portion 208 which may be located within extended neck portion 206. In some embodiments receiving portion 208 may comprise an inner surface which is enhanced with respect to the outer material of ear tip 202 in order to facilitate for additional securing force for attachment means 205. Such an enhancement may include adding additional elasticity to the inner surface, providing a more rigid surface which may facilitate a lock or snap fit with attachment means 205, and the like. The inner surface of receiving portion 208 may also include a secondary material which is seated or molded into ear tip 202.

It is noted that receiving portion 208 is placed within extended neck portion 206 in a manner that allows a substantial segment of extended neck portion 206 to remain unencumbered by speaker assembly 201. In doing so, extended neck portion 206 provides for additional flexibility of ear tip 202 during navigation within a user's ear while inserting and removing speaker assembly 201. Additionally, in some embodiments the placement depth of receiving portion 208 may be configured such that a portion of extended neck portion 206 extends over an edge of distal end 204 of speaker assembly 201 when speaker assembly 201 is attached to ear tip 202. In such embodiments this extension may assist in protecting a speaker within speaker assembly 201 from contamination or moisture which is common within an ear from body fluids such as earwax, sweat, etc. It is contemplated that this extension may comprise a slight extension over the edge of distal and 204. Further, such an extension may encompass any distance and even complete covering of speaker assembly 201.

Contact portion 207 of ear tip 202 may be configured in any suitable configuration, e.g. an open fit, vented or closed fit configuration. As illustrated, contact portion 207 is a mushroom or umbrella tip. However, embodiments may utilize other shapes (e.g. oblong, oval, and the like), or even a more solid structure where materials are included underneath the umbrella shape. In some embodiments, contact portion 207 is configured to have flexibility in order to assist forces which are present during navigation through the ear canal.

Figure 3:
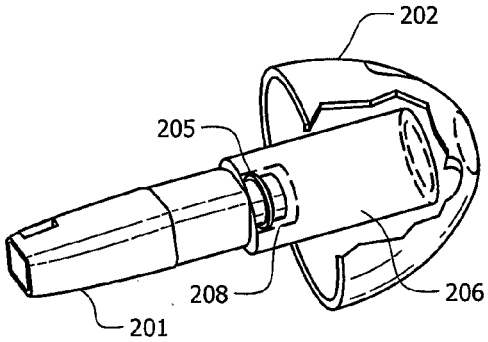
FIG. 3 illustrates the speaker assembly and ear tip of FIG. 2 in an assembled state.

FIG. 3 illustrates speaker assembly 201 and ear tip 202 of FIG. 2 in an assembled state. As can be seen, attachment means 205 is seated within receiving portion 208. Extended neck portion 206 extends substantially beyond attachment means 205 and the structure of receiver assembly 201 does not inhibit the flexibility of extended neck portion 206. Such an extension is counterintuitive in the art as it would be seen as exposing ear tip 202 to excessive risk of detachment during use due to pulling and torsion forces of insertion, removal and regular use. This is especially true when a only a slight overlap of extended neck portion 206 over receiver assembly 201 is used (as shown).

As discussed above, the overlap of extended neck portion 206 and receiver assembly 201 may assist in sealing receiver assembly 201 from contaminants which are commonly found in a user's ear. Additionally, while receiving portion 208 and attachment means 205 primarily function to secure receiver assembly 201 to ear tip 202, it is noted that the elasticity of extended neck portion 206 of ear tip 202 in contact with receiver assembly 201 (e.g. at the overlap) may also assist in securing receiver assembly 201 to ear tip 202. Another embodiment may include a plurality of umbrellas for additional sealing, positioning and/or fitting purposes.

Figure 4:
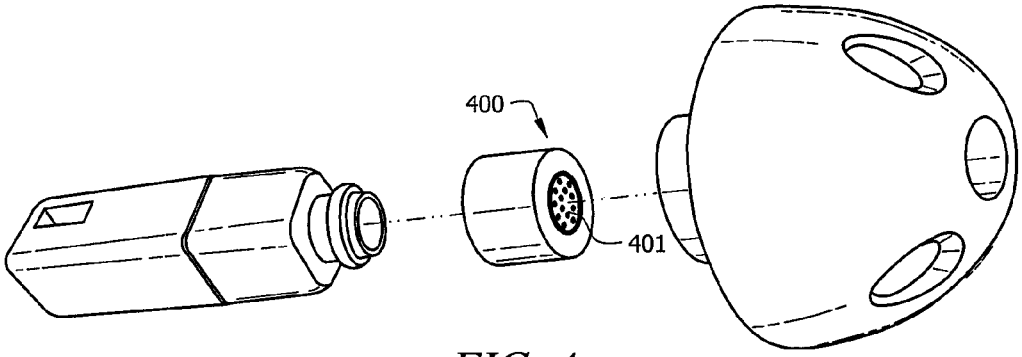
FIG. 4 illustrates a side view of an ear tip securing device in accordance with an embodiment of the present application.

FIG. 4 illustrates a side view of an ear tip securing device 400 in accordance with an embodiment of the present application. Ear tip securing device 400 may be configured to be inserted within an extended neck portion of an ear tip, such as within receiving portion 208 of FIG. 2. In some embodiments, ear tip securing device 400 is manufactured as a separate component and affixed within an ear tip. This may be accomplished during the manufacturing process where an ear tip is molded around ear tip securing device 400. Further, in some embodiments ear tip securing device 400 may be inserted after the manufacturing of an ear tip. When inserted after the fact, ear tip securing device 400 may utilize the elastic force of a neck portion of an ear tip to maintain its placement within the ear tip. Further, in some embodiments additional means for securing ear tip securing device 400 may be used such as gluing, heat fusing, etc.

Ear tip securing device 400 may be designed, shaped and selected for use based on the type of the type of attachment means utilized from a receiver assembly. For example, in an embodiment where the attachment means of a speaker assembly is a ball joint (as shown in FIG. 2), ear tip securing device 400 may be shaped to receive the ball joint in a snap fit configuration.

In some embodiments, ear tip securing device 400 may also include speaker guard screen 401. Speaker guard screen 401 as may act as a shield for a speaker assembly to protect it from contamination such as from earwax of a user. It is noted that a screen-like layout is useful because the openings in speaker guard screen 401 will allow sound from a speaker to propagate into a users ear. It may also be shaped to alter sound or include sound altering materials. For example, certain shapes or materials could be utilized which alter frequency responses of the acoustic device. In other embodiments, ear tip securing device 400 may omit speaker guard screen 401 altogether and leave a larger opening for sound to propagate into a users ear.

Figure 5:
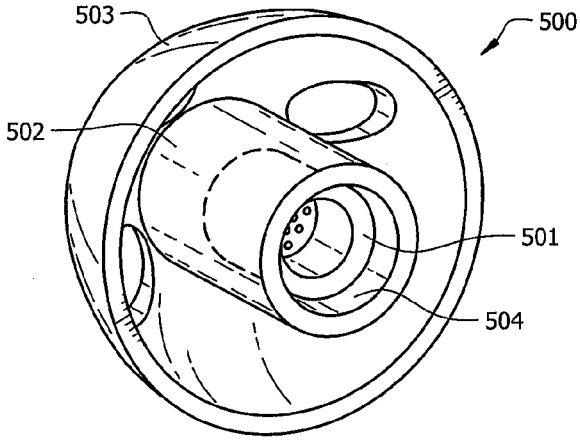
FIG. 5 illustrates a perspective view of an ear tip having a ear tip securing device (such as disclosed with respect to FIG. 4) inserted therein.

FIG. 5 illustrates a perspective view of an ear tip 500 having a ear tip securing device 501 (such as disclosed with respect to FIG. 4) inserted therein. Ear tip 500 includes an elongated neck portion 502 and a user contact portion 503. In this embodiment, ear tip securing device 501 is inserted such that an additional portion 504 of the elongated neck 502 extends beyond ear tip securing device 501. This additional portion 504 may be utilized to extend over the edge of a speaker assembly as is discussed in other embodiments. It is further noted that in the illustrated embodiment ear tip securing device 501 is seated partially along the length of the elongated neck portion 502 such that a length of neck portion 502 expands beyond ear tip securing device 501.

Figure 6:
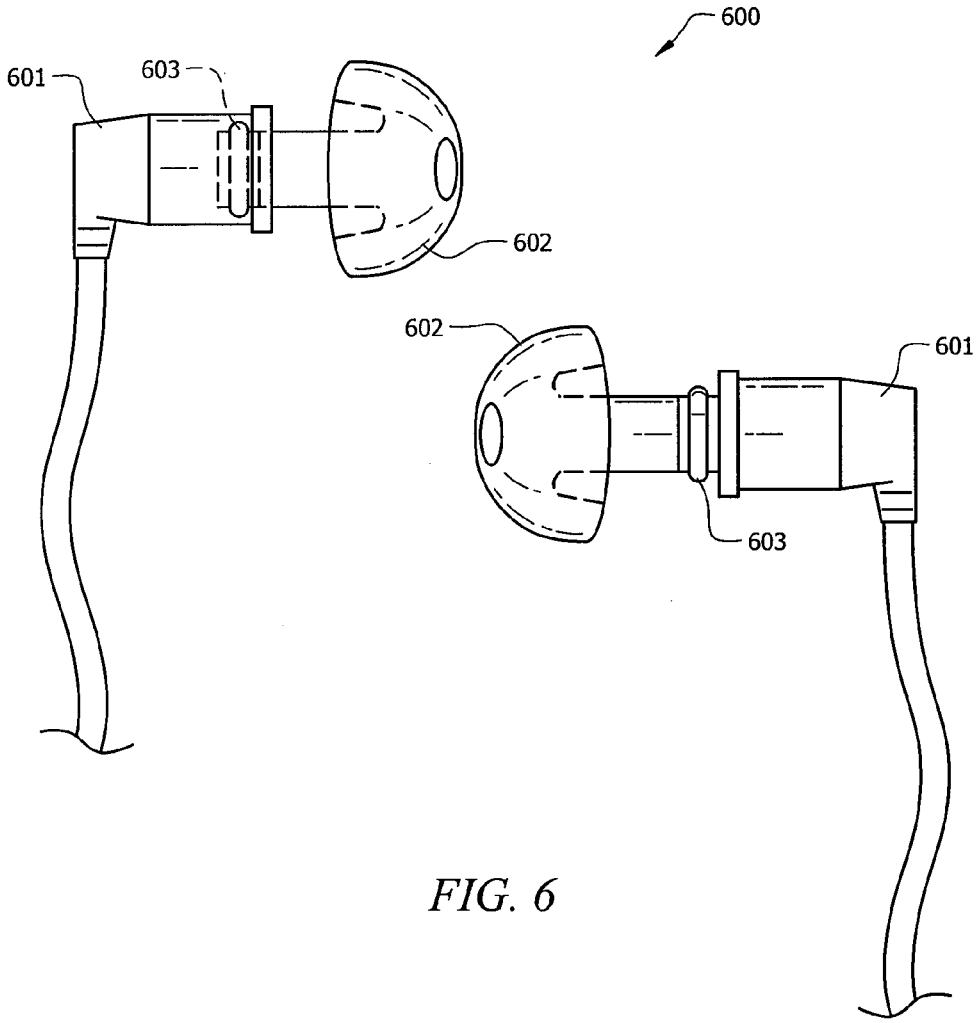
FIG. 6 illustrates an alternative earpiece auditory device in accordance with an embodiment of the present application.

FIG. 6 illustrates an alternative earpiece auditory device in accordance with an embodiment of the present application. This embodiment shows an "earbud-style" headphone system 600 which utilizes ear tips as discussed herein. Headphone system 600 may include a one or more speaker assemblies which may be attached to an ear tip 602 via an attachment means 603. In a headphone system it is noted that a speaker assembly, such as speaker assembly 601, may be designed to be inserted at varying depths within a user's ear. For example, a headphone system may be designed to be seated within a users ear such that the edge of the speaker is at the entrance of the ear canal. However, an increasing number of headphone systems are inserting speaker assemblies further within the ear canal. Accordingly, the length of any neck portion of the ear tip 602 may vary depending on the application and layout of the headphone system. Embodiments may utilize the inventive concepts outlined herein to both secure the ear tip onto a speaker assembly of a headphone system, and to allow for additional flexibility when inserting the ear tips within an ear canal so as to allow the ear tips and/or speaker assemblies to navigate the bends of the ear canal.

Figure 7:
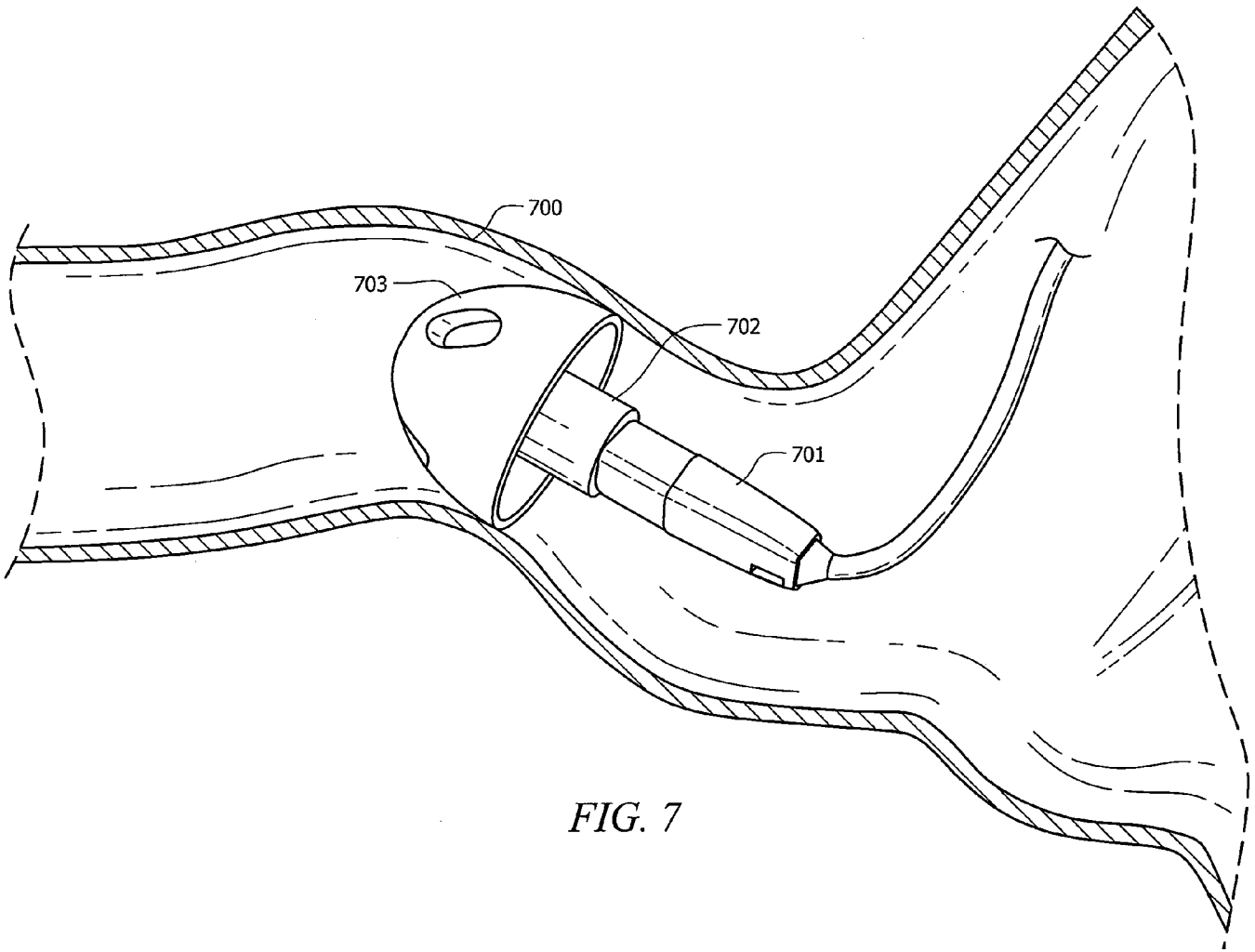
FIG. 7 illustrates a side view of an ear canal having a hearing aid inserted therein.
Figure 8:
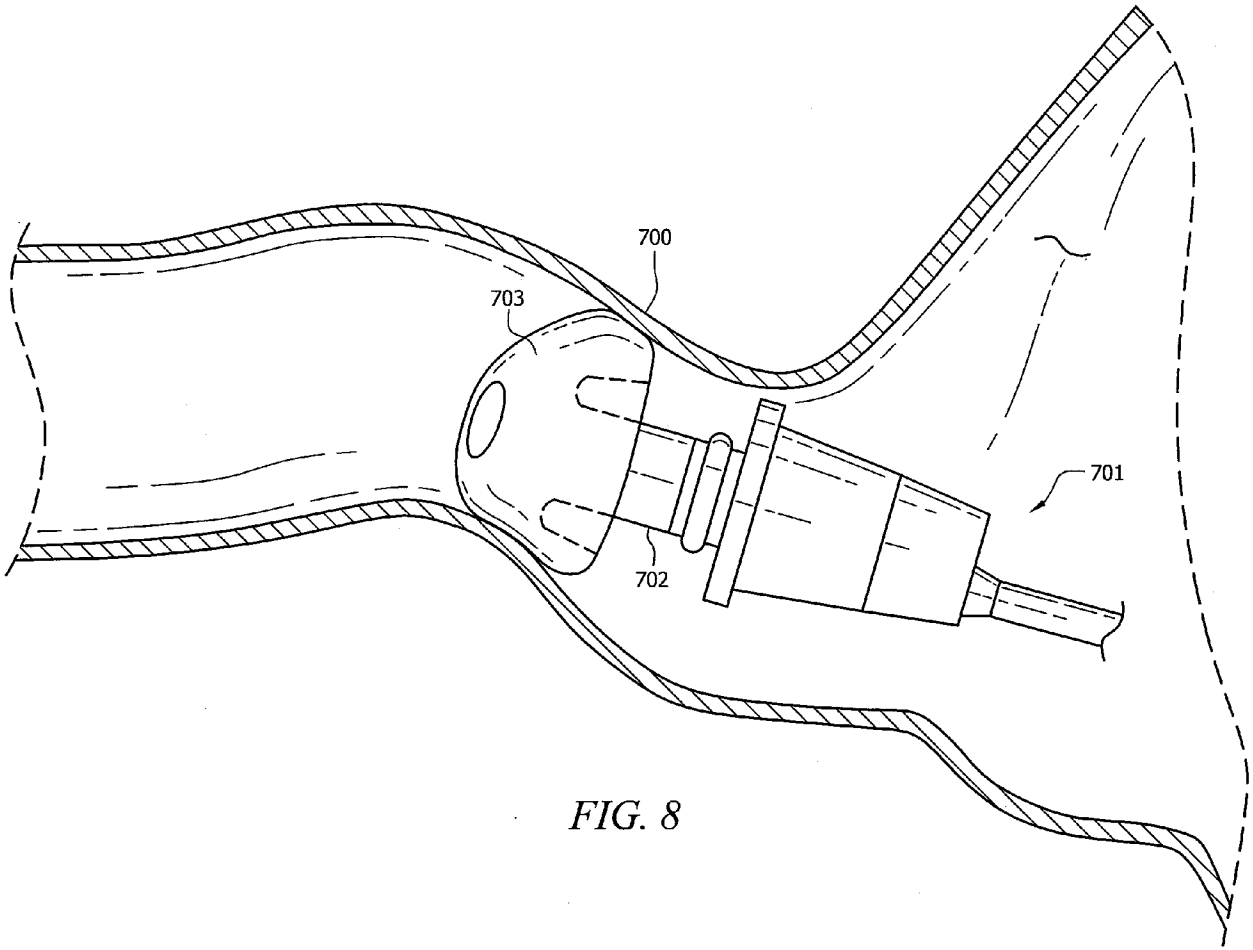
FIG. 8 illustrates a side view of an ear canal having a headphone device inserted therein.

FIGS. 7 and 8 illustrate a side view of an ear canal 700 having various auditory devices 701 inserted therein. As can be seen, the ear canal 700 has multiple bends. It is appreciated that these bends are different angles for different users. Additionally, the diameter of the ear canal may vary significantly among different users. The additional flexibility of the elongated neck portion 702 as well as contact area 703 may be utilized to assist the user in inserting auditory device 701 as it navigates portions of a user's ear canal.

It is noted that in FIG. 8, which illustrates and ear-bud style embodiment, the coupling between the speaker assembly 701 and elongated neck portion 702 may be past the ear canal aperture opening when the device is in use.

While the above embodiments have been discussed in reference to a single auditory device and the corresponding ear tip, systems and methods may include utilization of a plurality of different types of components which may be selected in order to customize a device for a particular type or fit for a user. The fit can be modified for a particular purposes in various ways. For example, the combinations of materials used, the durometer of materials used, wall thickness of the neck, the length of the neck, etc., can be modified to allow the neck to be either more or less rigid for insertion. There may be design tradeoffs which allow for a more rigid material while having a lesser wall thickness, or vice versa. Such tradeoffs may affect any number of aspects such as the comfort/fit and even performance of an acoustic device. Additionally, the umbrella wall may be modified for similar reasons, and may even include a different material than that of the neck portion.

For example, one embodiment may provide for a method for fitting an earpiece auditory device or an auditory device system. Such systems and methods may include providing a plurality of ear tips of varying size, wherein a single ear tip may be selected for a respective speaker assembly in order to provide for a more precise fit for a particular user's ear. Moreover, in some embodiments, a plurality of ear tips may be provided which correspond to different attachment means that may be utilized by a speaker assembly.

It is contemplated that systems and methods involving varying kits with multiple speaker assemblies, ear tips, and even processing circuitry housings (such as a BTE component) may be utilized in accordance with the inventive concepts outlined herein, and such embodiments are deemed to be within the scope of the present application.

Although embodiments of the present application and specific advantages have been described in detail, it should be understood that various changes, substitutions and alterations can be made herein without departing from the spirit and scope of the application as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present application, processes, machines, manufacture, compositions of matter, means, methods, or steps, presently existing or later to be developed that perform substantially the same function or achieve substantially the same result as the corresponding embodiments described herein may be utilized according to the present application. Accordingly, the appended claims are intended to include within their scope such processes, machines, manufacture, compositions of matter, means, methods, or steps.

What is claimed is:

1. An auditory device comprising:

a behind-the-ear component comprising sound processing circuitry;

a completely-in-canal (CIC) component including a speaker casing having a proximal end and a distal end, said speaker casing having an ear tip attachment means extending past the distal end, said attachment means including an extension having a reduced diameter with respect to said speaker casing and a snap portion disposed on said extension;

a connector configured to couple the behind-the-ear component to the completely-in-canal component; and an ear tip having an extended neck portion comprising a proximal end and a distal end, and a user contact portion disposed on the distal end which is configured to contact a surface of an ear canal of a user, said ear tip configured to couple to said attachment means of said CIC device at an attachment point disposed in the inner surface of the extended neck portion at the proximal end, said ear tip further configured such that said extended neck portion extends substantially beyond the end of said attachment means when coupled to the ear tip at said attachment point, whereby the structure of the CIC does not inhibit the flexibility of the extended neck portion that extends beyond the attachment means.

2. The auditory device of claim 1 wherein said extended neck portion is configured to have flexibility such that the ear tip may bend when navigating the ear canal.

3. The auditory device of claim 2 wherein said attachment means is configured to maintain a secure attachment when experiencing pulling and torsion forces from bending of said extended neck.

4. The auditory device of claim 1 wherein said user contact portion comprises a mushroom tip.

5. The auditory device of claim 1 wherein said user contact portion is flexible for guidance through an ear canal upon insertion of said auditory device.

6. The auditory device of claim 1 wherein said ear tip is an open fit tip.

7. The auditory device of claim 1 wherein said ear tip is a closed fit tip.

8. The auditory device of claim 1 wherein said attachment means is a ball joint configured to snap fit with said ear tip.

9. The auditory device of claim 8 wherein said extended neck portion comprises an outer surface and an inner securing device disposed on the inner surface of the neck portion.

10. The auditory device of claim 9 wherein said inner securing device is formed by a separate ear tip securing device.

11. The auditory device of claim 9 wherein said inner securing device is molded within said neck portion.

12. The auditory device of claim 1 wherein the extended neck portion is configured to extend only partially over an edge of said distal end of said speaker casing.

13. The auditory device of claim 12 wherein the extension over said distal end creates a seal to assist in protecting the speaker from contamination.

14. An ear tip comprising:

a hollow elongated neck portion defining an axial length and having a first and second end;

a tip portion formed on said first end, said tip portion configured to have limited flexibility to assist with the insertion of said tip within an ear canal; and an attachment portion disposed within the inner surface of the second end of said hollow elongated neck portion, said attachment portion configured to mate with a corresponding attachment portion of a speaker assembly, said attachment portion disposed at a point proximate to said second end such that a substantial portion of said axial length of said elongated neck portion extends beyond said attachment portion toward said first end whereby the structure of the speaker assembly does not inhibit the flexibility of the extended neck portion that extends beyond the attachment means.

15. The ear tip of claim 14 wherein said axial length extending beyond said attachment portion is configured to have limited flexibility to assist with the insertion of said tip within an ear canal.

16. The ear tip of claim 14 wherein said second end is configured to extend partially over an attachment portion when engaged with said attachment portion.

17. The ear tip of claim 14 wherein said attachment portion is configured to facilitate a snap fit with a ball joint.

18. The ear tip of claim 14 wherein said attachment portion comprises a separate component part configured to be attached within said hollow neck portion.

19. The ear tip of claim 14 wherein the ear tip is configured to attach to a hearing aid device.

20. The ear tip of claim 14 wherein the ear tip is configured to attach to an audio headphone device.

21. The ear tip of claim 20 wherein the attachment location of the ear tip to an audio headphone device is within the ear canal when the device is inserted into a user's ear.

22. A method for creating an ear tip, said method comprising:

forming an elongated hollow tube portion having a first end and a second end, said first end configured to be proximate to a speaker assembly and said second end configured to extend into a user's ear canal;

disposing a speaker assembly attachment portion within said elongated hollow tube portion said speaker assembly attachment portion configured to mate with a corresponding attachment portion of a speaker assembly, said speaker assembly attachment portion placed proximate to said first end such that a substantial portion of said elongated hollow tube portion extends beyond said speaker assembly attachment portion whereby the structure of the speaker assembly does not inhibit the flexibility of the extended neck portion that extends beyond the attachment means;

forming, on said second end, a user contact portion configured to contact the surface of a user's ear canal.

23. The method of claim 22 further comprising configuring said ear tip to attach to a hearing aid device.

24. The method of claim 22 further comprising configuring said ear tip to attach to a personal audio headphone device.

25. The auditory device of claim 9 wherein the inner securing device is seated partially along the length of the extended neck portion such that a length of the extended neck potion extends beyond inner securing device toward the distal end of said CIC component.

26. The auditory device of claim 9 wherein the inner securing device further comprises a guard screen.

* * * * *